US006213160B1

(12) United States Patent
Birk

(10) Patent No.: US 6,213,160 B1
(45) Date of Patent: Apr. 10, 2001

(54) VOLTAGE DELIVERY AND MOVABLE LOOM OPERATING DEVICES

(75) Inventor: Michael Birk, Hergensweiler (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 0 days.

(21) Appl. No.: 09/531,767

(22) Filed: Mar. 20, 2000

(30) Foreign Application Priority Data

Mar. 19, 1999 (DE) ..... 299 05 052 U

(51) Int. Cl.[7] ..... D03D 54/02; D03D 49/02
(52) U.S. Cl. ..... 139/1 E; 318/16
(58) Field of Search ..... 318/16; 139/1 E

(56) References Cited

U.S. PATENT DOCUMENTS 4,234,021 * 11/1980 Clokie ..... 139/370.1
4,768,564 * 9/1988 Yamada ..... 139/97
5,551,485 * 9/1996 Faulkner ..... 139/353

FOREIGN PATENT DOCUMENTS

1003474A3 3/1992 (BE) .
0225517A1 11/1986 (EP) .
0262683A2 10/1987 (EP) .
0404979A1 6/1989 (EP) .
8-284046 * 10/1996 (JP) .
WO 88/09405 * 12/1988 (WO) .
WO 98/14652A1 4/1998 (WO) .

OTHER PUBLICATIONS tpi, "Maschinen des Jahres", 1991 No Trans.
Prospekt "Air Jet Loom", No Date Supplied.

* cited by examiner

*Primary Examiner*—Andy Falik
(74) *Attorney, Agent, or Firm*—Evenson, McKeown, Edwards & Lenahan, P.L.L.C.

(57) ABSTRACT

A device for operating a weaving loom, including at least one carrier rail (5) which extends along a large portion of the weaving loom width and on which at least one operating device (1) can be arbitrarily moved. The device also includes structures for the wireless and/or wire-dependent voltage supply to the operating device (1), and for the signal transmission of control commands to the weaving loom control system. An alternative embodiment consists of constructing the operating device (1) as a portable remote operating unit (11) which has devices for the wireless signal transmission of control commands to the weaving loom control system.

12 Claims, 2 Drawing Sheets

VOLTAGE DELIVERY AND MOVABLE LOOM OPERATING DEVICES

BACKGROUND AND SUMMARY OF THE INVENTION

This application claims the priority of German Patent No. 29905052.1, filed Mar. 19, 1999, the disclosure of which is expressly incorporated by reference herein.

The invention relates to a device for operating at least one weaving loom. Weaving looms are normally equipped, according to their function and size, with two or more fixedly mounted operating devices which are distributed over the width of the loom. In this case, several operating devices can be arranged on the front side and several operating devices can be arranged on the rear side of the weaving loom. By way of these operating devices, control commands for the weaving loom can be transmitted to the weaving loom control. Because of the number of the operable functions and the operating switches and displays required for this purpose, the space requirement for these operating devices is constantly increasing. However, in addition to this space requirement, higher wiring expenditures for the connection of the operating devices are also necessary.

It is an object of the invention to provide a device for operating a weaving loom which avoids a multiple arrangement of operating devices, whereby, on the whole, in comparison to the prior art, lower space requirements and lower wiring expenditures are achieved.

This object is achieved according to the invention by providing at least one operating device which can be arbitrarily moved on a carrier rail along a large portion of the weaving loom width and which has devices for the wireless and/or wire-dependent voltage supply and for the signal transmission of control commands to the weaving loom control system.

As a result, the weaver can position the operating device at a desired point required for the respective operating situation.

Other objects, advantages and novel features of the present invention will become apparent from the following detailed description of the invention when considered in conjunction with the accompanying drawings.

BRIEF DESCRIPTION OF THE DRAWINGS

In the following, the invention will be explained in detail by means of two embodiments with reference to the figures of the drawing.

DETAILED DESCRIPTION OF THE PREFERRED EMBODIMENT

Figure 1:
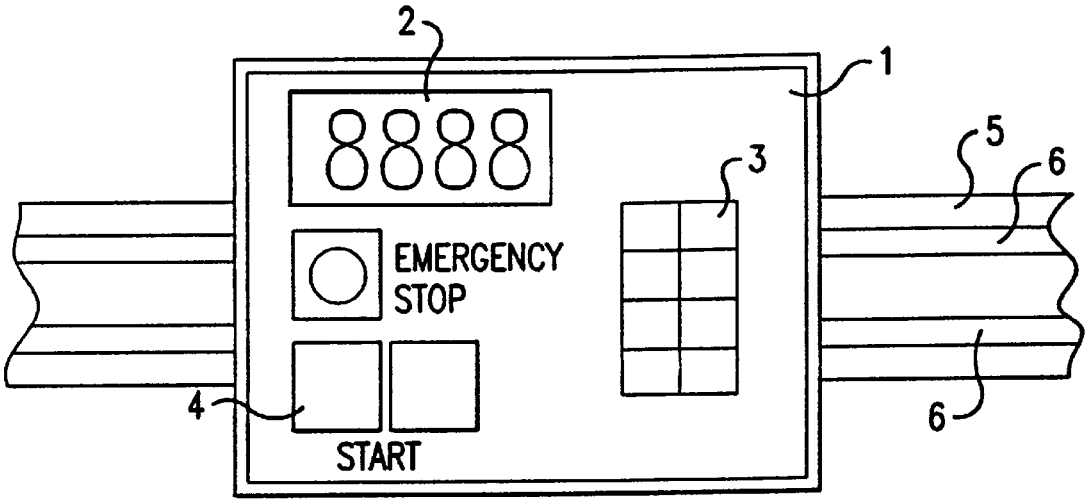
FIG. 1 is a top view of the operating device which can be moved on a carrier rail.
Figure 2:
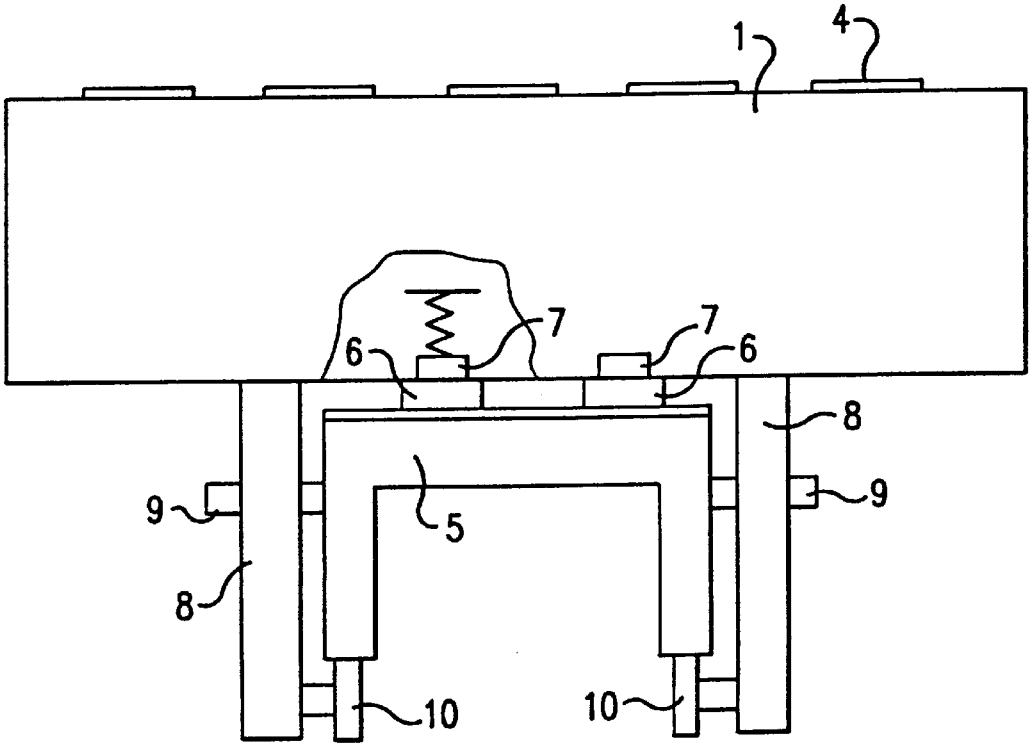
FIG. 2 is a lateral view of the embodiment illustrated in FIG. 1.

A first embodiment of the invention is illustrated in FIGS. 1 and 2. The figures of the drawing show an operating device 1 which, in a known manner, has keyboards 2, 3 or individual large keys 4, for example, for the "start" or "emergency off" functions, on its top side. According to the invention, it is now provided that this operating device 1 can be arbitrarily moved on a carrier rail 5 which preferably extends along the whole weaving loom width, in which case, the carrier rail can be arranged on the front side as well as on the rear side of the weaving loom. The carrying construction of the carrier rail can be connected with the loom frame. However, it may also be arranged and fastened in a different manner.

Figure 4:
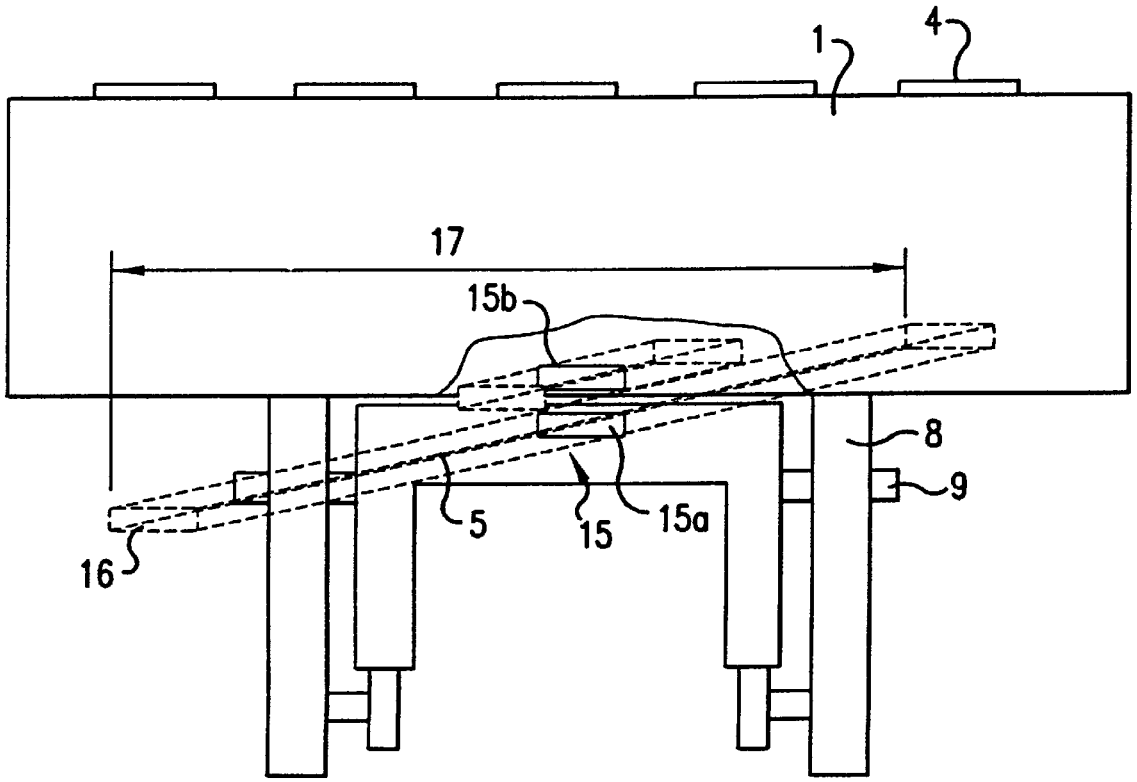
FIG. 4 illustrates an example of an inductive alternating field generating device.

The carrier rail 5 preferably has at least one conductor rail 6 which extends along the whole length of the carrier rail and is used for supplying voltage to the operating device 1. Simultaneously, by way of the conductor rails 6, the control commands generated by the operating device 1, can be transmitted, for example, in the form of digital pulses, to the weaving loom control system. Another possibility consists of equipping the operating device 1 as well as the weaving loom control system with a wireless data transmitting device, so that control commands are transmitted by radio or by way of optical signals. to the weaving loom control system. A voltage supply to the operating device 1 and a signal transmission can be achieved as an alternative by means of inductive alternating fields. An example of an inductive alternating field is shown in FIG. 4 wherein an inductive coupling unit 15 includes both a coil 15*a* having an electrical connection 16 and a magnet 15*b*. The coil 15*a* is included in the carrier rail 5 while the magnet 15*b* is positioned diametrically opposite to the coil in the movable operating device 1. The effective length of the coil 15*a* and/or the travel path of the operating device 1 is indicated by the distance 17.

As illustrated particularly in FIG. 2, the carrier rail is constructed as a U-profile, in which case the conducting rails 6 are arranged on the top side of the carrier rail opposite corresponding sliding contacts 7 arranged on the operating device 1. For the purpose of a good guidance of the operating device 1 on the carrier rail 5, the operating device has corresponding holding devices 8, on which moving means such as the rollers 9, 10 are arranged which cause the guiding of the operating device on the carrier rail 5. The roller bearing ensures an easy mobility of the operating device 1. Slide bearings are also conceivable for the guiding of the operating device 1.

Figure 3:
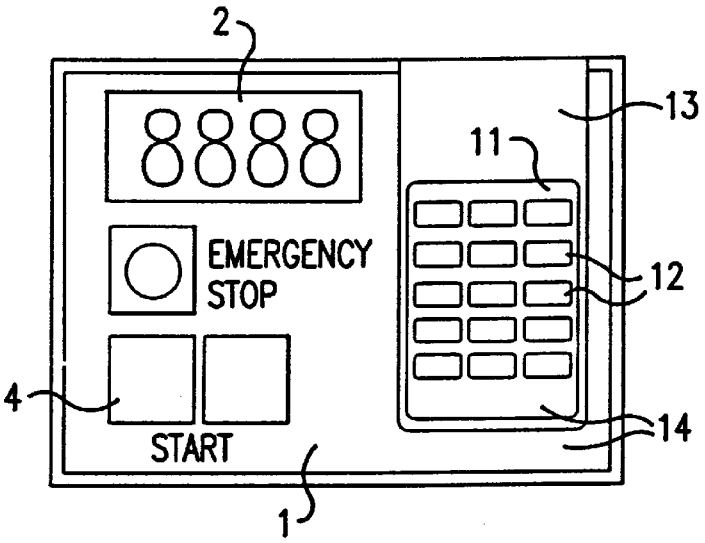
FIG. 3 is a top view of a second embodiment of the operating device with the control unit.

According to a second embodiment of the invention illustrated in FIG. 3, it is provided to equip the operating device 1 with a portable operating unit 11. This operating unit 11 is held, for example, in a shaft 13 in the operating device 1 and has an infrared interface 14 by way of which it communicates with the operating device 1. The operating unit 11 has a keyboard 12 for the necessary operations, in which case the control commands are transmitted by way infrared from the operating unit 11 to the operating device 1 and farther to the weaving loom control system.

In order to comply with safety regulations, however, the emergency off key and other important function keys remain separately on the operating device 1, so that they are accessible to anyone at any time. For being able to assign the operating unit 11 to a certain weaving loom, it comprises a coding device.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A system for operating a weaving loom, comprising:

an operating device;

means for moving said operating device along a substantial portion of said weaving loom;

a voltage delivery device for supplying voltage to said operating device; and at least one signal transmission device for transmitting control command signals from said operating device to a control system of said weaving loom 1, wherein said voltage delivering device includes a carrier rail having at least one conductor rail wherein said at least one conductor rail is in operative connection with sliding contacts arranged on said operating device in order to supply said voltage to the operating device.

2. The system according to claim 1, further including a cable tracking guidance structure for supplying at least one of said voltage and said control command signals.

3. The apparatus according to claim 1, wherein said operating device includes one of a radial and an infrared interface for transmission of said signal.

4. The system according to claim 1, wherein said carrier rail is adapted to be connected to a frame of said loom.

5. A system for operating a weaving loom, comprising:

an operating device;

means for moving said operating device along a substantial portion of said weaving loom;

a voltage delivery device for supplying voltage to said operating device; and at least one signal transmission device for transmitting control command signals from said operating device to a control system of said weaving loom wherein said voltage delivery device includes a carrier rail containing at least one conductor rail wherein said at least one conductor rail is an operative communication with sliding contacts arranged on the operating device for providing signal transmission to said operating device.

6. The system according to claim 5, further including a cable tracking guidance structure for supplying at least one of said voltage and said control command signals.

7. The apparatus according to claim 5, wherein said operating device includes one of a radial and an infrared interface for transmission of said signal.

8. The system according to claim 5, wherein said carrier rail is adapted to be connected to a frame of said loom.

9. A system for operating a weaving loom, comprising:

an operating device;

means for moving said operating device along a substantial portion of said weaving loom;

a voltage delivery device for supplying voltage to said operating device; and at least one signal transmission device for transmitting control command signals from said operating device to a control system of said weaving loom wherein said voltage delivery device includes an inductive alternating field generating device for generating said voltage.

10. The system according to claim 9, further including a cable tracking guidance structure for supplying at least one of said voltage and said control command signals.

11. The apparatus according to claim 9, wherein said operating device includes one of a radial and an infrared interface for transmission of said signal.

12. The system according to claim 9, wherein said carrier rail is adapted to be connected to a frame of said loom.

* * * * *